US009328461B2

(12) United States Patent
Fujita et al.

(10) Patent No.: US 9,328,461 B2
(45) **Date of Patent: *May 3, 2016**

(54) SHEET MANUFACTURING APPARATUS

(71) Applicant: SEIKO EPSON CORPORATION, Tokyo (JP)

(72) Inventors: Shigeo Fujita, Nagano (JP); Katsuhito Gomi, Nagano (JP); Shunichi Seki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/486,358

(22) Filed: Sep. 15, 2014

(65) Prior Publication Data

US 2015/0096703 A1 Apr. 9, 2015

(30) Foreign Application Priority Data

Oct. 3, 2013 (JP) ..... 2013-207965

(51) Int. Cl.

| | |
|---|---|
| ***D21F 7/00*** | (2006.01) |
| ***D21F 9/00*** | (2006.01) |
| ***B65H 29/12*** | (2006.01) |
| ***B65H 29/14*** | (2006.01) |

(52) U.S. Cl.

CPC ..... *D21F 9/00* (2013.01); *B65H 29/125* (2013.01); *B65H 29/14* (2013.01); *B65H 2301/121* (2013.01); *B65H 2301/5143* (2013.01); *B65H 2301/5144* (2013.01); *B65H 2801/84* (2013.01)

(58) Field of Classification Search

None

See application file for complete search history.

(56) References Cited

U.S. PATENT DOCUMENTS

| | | | | |
|---|---|---|---|---|
| 2,006,499 | A * | 7/1935 | Fourness et al. | 242/523.1 |
| 5,422,710 | A | 6/1995 | Shirasaka et al. | |
| 5,774,204 | A | 6/1998 | Suzuki et al. | |
| 6,243,558 | B1 | 6/2001 | Oota | |
| 7,386,268 | B2 | 6/2008 | Terashima | |
| 9,074,320 | B2 * | 7/2015 | Gomi | |
| 2006/0067736 | A1 | 3/2006 | Kim et al. | |
| 2010/0054787 | A1 | 3/2010 | Nagai et al. | |
| 2011/0076067 | A1 | 3/2011 | Nagai et al. | |
| 2011/0217100 | A1 | 9/2011 | Yoshikawa | |
| 2014/0027075 | A1 | 1/2014 | Yamagami et al. | |
| 2014/0374047 | A1 | 12/2014 | Yamagami | |

FOREIGN PATENT DOCUMENTS

| | | | |
|---|---|---|---|
| JP | 53-038785 | B | 10/1978 |
| JP | 2009-299217 | A | 12/2009 |
| WO | 2012/095928 | A1 | 7/2012 |

OTHER PUBLICATIONS

Extended European Search Report for European Patent Application No. 14187602.9 dated Feb. 18, 2015.

* cited by examiner

*Primary Examiner* — Mark Halpern

(74) *Attorney, Agent, or Firm* — Global IP Counselors, LLP

(57) ABSTRACT

A sheet manufacturing apparatus includes a web forming unit configured to form a web that includes fibers and a resin, a transferring unit configured to transfer the web that has been formed, a first cutting unit configured to cut the web in a direction intersecting with a transfer direction of the web being transferred, and a heating unit having a first roller configured to heat the web that has been cut.

10 Claims, 3 Drawing Sheets

SHEET MANUFACTURING APPARATUS

CROSS-REFERENCE TO RELATED APPLICATIONS

This application claims priority to Japanese Patent Application No. 2013-207965 filed on Oct. 3, 2013. The entire disclosure of Japanese Patent Application No. 2013-207965 is hereby incorporated herein by reference.

BACKGROUND

1. Technical Field

The present invention relates to a sheet manufacturing apparatus.

2. Related Art

Conventionally known are recycled pulp molding and drying apparatuses (for example, see Japanese laid-open patent publication No. 2009-299217) provided inter alia with a mesh belt conveyor for transferring a web (a "pulp sheet" in Japanese laid-open patent publication No. 2009-299217), a cutter for cutting the transferred web to a predetermined length, and heating and pressing machine that is arranged more downstream than the cutter in the direction of transfer of the web and heats and dries the cut web.

However, the heating and pressing machine of the recycled pulp molding and drying apparatus is a configuration where the web is held down with a planar lower pressing unit and a planar upper pressing unit, and therefore there is a need for a lower pressing unit and an upper pressing unit of a size that corresponds to the size of the web. For this reason, a problem emerges in that the apparatus configuration is increased in size.

SUMMARY

The present invention has been made in order to solve this problem, and can be implemented as the following aspects or application examples.

A sheet manufacturing apparatus as in the application example is characterized by being provided with a web forming unit configured to form a web that includes fibers and a resin, a transferring unit configured to transfer the web that has been formed, a first cutting unit configured to cut the web in a direction intersecting with a transfer direction of the web being transferred, and a heating unit having a first roller configured to heat the web that has been cut.

According to the configuration of such description, the formed web is first cut in a direction intersecting with the transfer direction of the web. For this reason, the occurrence of skewing (such as meandering or bending in the transferring of the web) of the web being transferred is curbed. A web that is not cut in a direction intersecting with the transfer direction will be continuous, experiences skewing, and even still is less readily corrected. Effectuating a state of having been cut and made into the form of a sheet facilitates correction of skewing. Then, after having been cut, the web is heated. Because the web is heated in a state where the orientation of the web has been aligned, it is possible to heat evenly. Because the web is heated after having been cut, the web can be prevented from generating cutting powder or the like. The web is also heated by a heating unit in the form of a roller. This makes it possible to continuously manufacture the sheet and to reduce the apparatus configuration in size compared to a case of heating with a planar pressing machine. A case where a planar pressing apparatus is used would necessitate a buffer unit for temporarily giving slack to the web being transferred when the pressing is being performed.

The sheet manufacturing apparatus as in the above application example, further comprises a second cutting unit configured to cut the web along the transfer direction of the web, and the second cutting unit is arranged on the downstream side in the transfer direction relative to the heating unit.

According to the configuration of such description, it becomes possible to cut along the transfer direction of the web in a state where skewing has been reduced. This makes it possible to accurately cut the web to the desired dimensions.

The sheet manufacturing apparatus as in the above application example further comprises a cooling unit configured to cool the web, and the cooling unit is arranged between the heating unit and the second cutting unit in the transfer direction.

According to the configuration of such description, the web is cooled after having been heated by the heating unit. Because of this cooling, the web in a softened state following the heating is cooled by the cooling and the strength is increased. The cutting is performed in a state where the strength of the web has been ensured. As such, the web can be accurately cut to the desired dimensions. Here, the "cooling unit" is understood to encompass a unit that does not heat. That is to say, the cooling unit is provided with a function where the temperature is lower than that of the web that has been heated by the heating unit.

The heating unit of the sheet manufacturing apparatus as in the above application example is configured to cause the fibers included in the web to bind to one another, with the resin interposed therebetween.

According to the configuration of such description, the strength of the resulting sheet can be upheld and a high-quality sheet can be manufactured.

The sheet manufacturing apparatus as in the above application example further comprises a preheating unit that includes a second roller configured to heat the web at a lower temperature than the heating unit, and the preheating unit being arranged between the web forming unit and the first cutting unit in the transfer direction.

According to the configuration of such description, the web is heated in advance at an earlier stage than the heating unit. This increases the tensile strength of the web itself. Then, after the preheating, the web is cut in the direction intersecting with the transfer direction of the web. As such, any breaking of the web at the time of cutting can be curbed.

BRIEF DESCRIPTION OF THE DRAWINGS

Referring now to the attached drawings which form a part of this original disclosure.

DETAILED DESCRIPTION OF EXEMPLARY EMBODIMENTS

Embodiments of the present invention shall be described below, with reference to the accompanying drawings. In each of the drawings given below, the scale of the respective members and the like has been illustrated differently from the actual scale, in order to increase the size of respective members and the like to such an extent as to be visually recognizable.

First, the configuration of a sheet manufacturing device shall be described. The sheet manufacturing apparatus is based on, for example, a technique where a stock material (material to be defibrated) Pu such as a pure pulp sheet or used paper is formed into a new sheet Pr. The sheet manufacturing apparatus as in the present embodiment is provided inter alia with: a web forming unit for forming a web comprising fibers and a resin; a transferring unit for transferring the web thus formed; a first cutting unit for cutting the web in a direction intersecting with a transfer direction of the web being transferred; and a heating unit having a first roller for heating the web thus cut. The "web" as in the present embodiment refers to a mode of configuration of an object comprising fibers and a resin. As such, a case where the mode of the dimensions or the like is changed during heating, compression, cutting, transfer, or the like of the web would still be illustrative of the web. The configuration of the sheet manufacturing apparatus shall be described in greater detail below.

Figure 1:
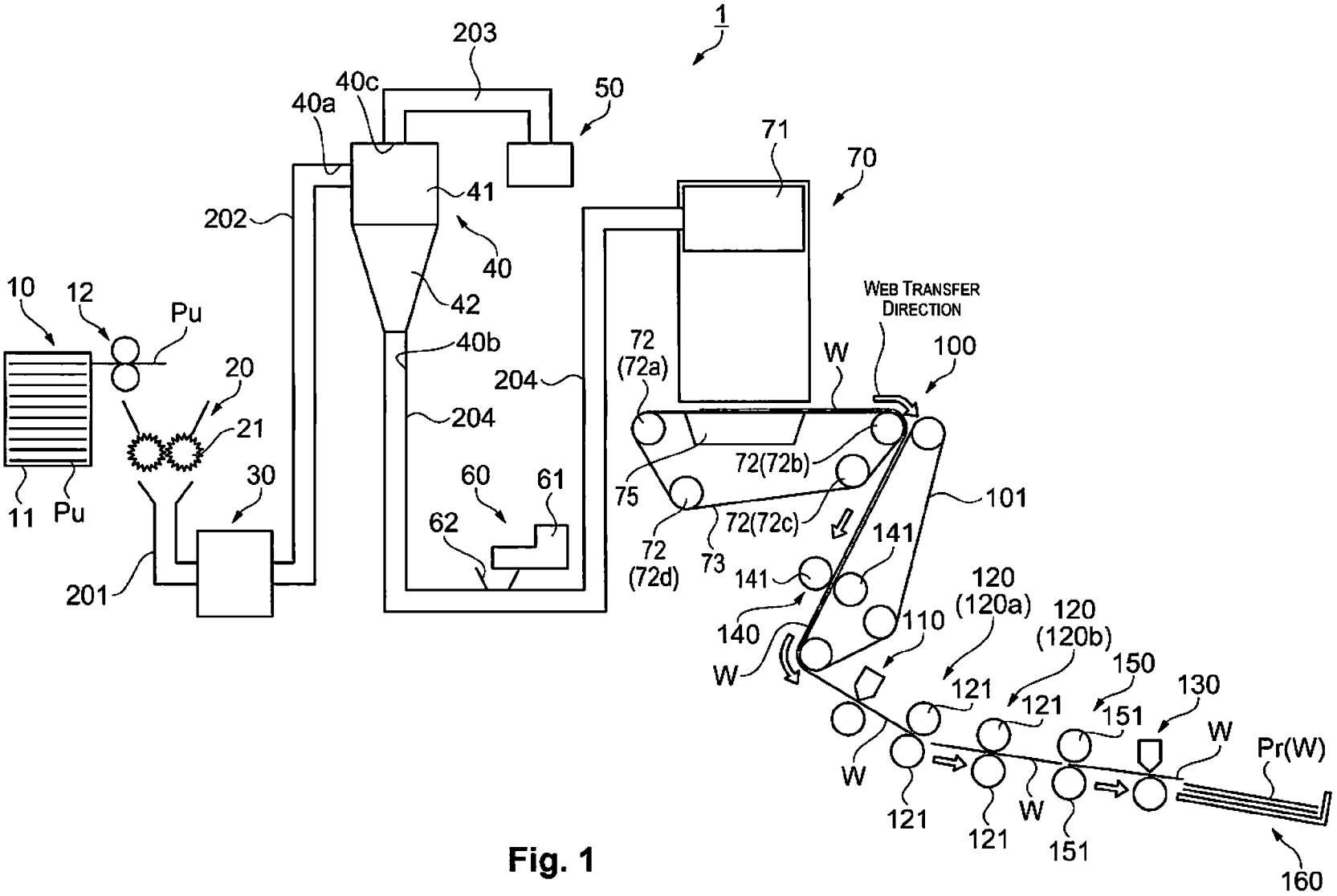
FIG. 1 is a schematic diagram illustrating the configuration of a sheet manufacturing apparatus.
Figure 2A:
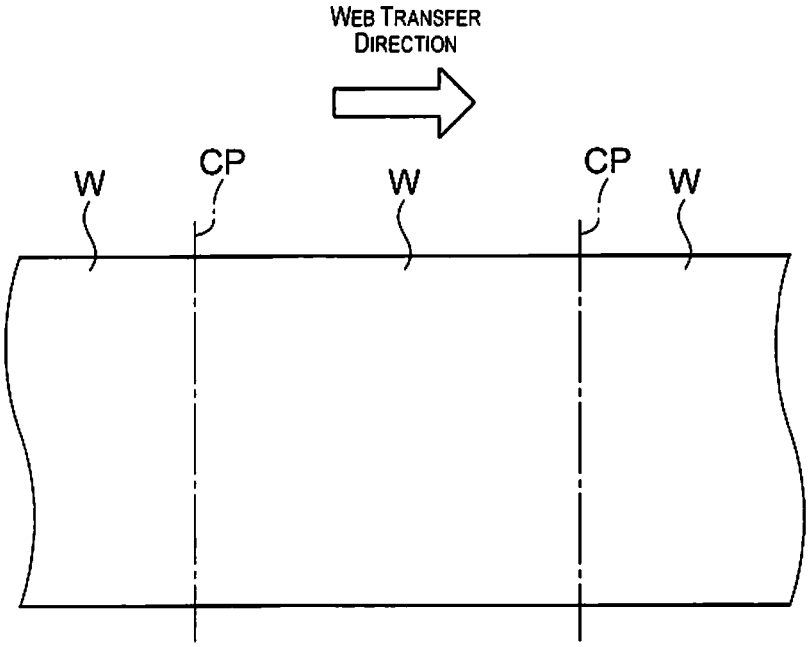
FIG. 2A is a schematic view illustrating a part of an operation of the sheet manufacturing apparatus.
Figure 2B:
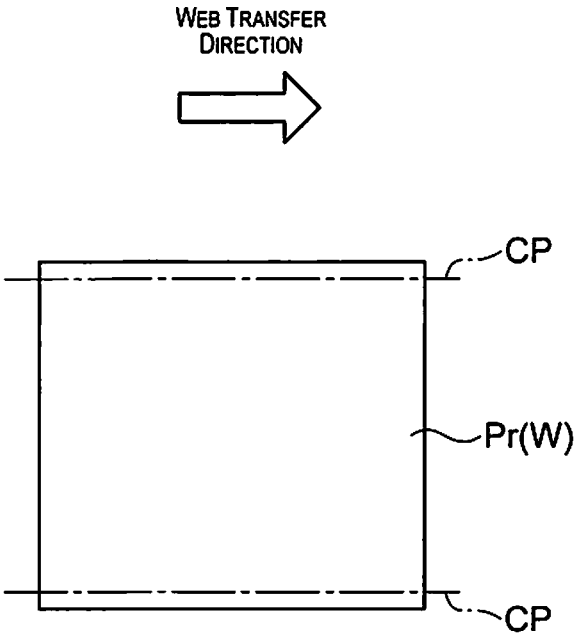
FIG. 2B is a schematic view illustrating a part of the operation of the sheet manufacturing apparatus.

FIG. 1 is a schematic diagram illustrating the configuration of a sheet manufacturing apparatus as in the present invention, and FIGS. 2A and 2B are schematic diagrams illustrating a part of the operation of the sheet manufacturing apparatus. As illustrated in FIG. 1, a sheet manufacturing apparatus 1 is provided inter alia with a supplying unit 10, a crushing unit 20, a defibrating unit 30, a classifier unit 40, a receiving unit 50, an additive agent feeding unit 60, a web forming unit 70, a transferring unit 100, a first cutting unit 110, and a heating unit 120. Furthermore, in the present embodiment, the sheet manufacturing apparatus 1 is also provided with a second cutting unit 130, a preheating unit 140, and a cooling unit 150.

The supplying unit 10 is for supplying the used paper Pu to the crushing unit 20. The supplying unit 10 is provided inter alia with, for example, a tray 11 on which a plurality of sheets of the used paper Pu are overlaid and accumulated, and an automatic feed mechanism 12 with which the used paper Pu in the tray 11 can be continuously fed to the crushing unit 20. Examples of the used paper Pu supplied to the sheet manufacturing apparatus 1 include A4-size paper, which is currently the norm in offices.

The crushing unit 20 is for cutting the used paper Pu thus supplied into pieces of paper that are several centimeters square. In the crushing unit 20, crushing blades 21 are provided, to constitute such an apparatus as to broaden the cutting width of blades in an ordinary shredder. This makes it possible to easily cut the used paper Pu thus supplied into pieces of paper. The crushed paper that has been divided is then supplied to the defibrating unit 30 via a tubing 201.

The defibrating unit 30 is provided with a rotating blade that rotates (not shown), and is for defibrating, where the crushed paper supplied from the crushing unit 20 is unraveled into fibers. The defibrating unit 30 of the present embodiment is one that performs defibrating in air with a dry type. Printed ink or toner, anti-bleeding materials, or other coating materials on the paper or the like are turned into particles several tens of μm or smaller (hereinafter called "ink particles") and separated from the fibers by the defibration treatment of the defibrating unit 30. As such, the defibrated material exiting from the defibrating unit 30 is ink particles and fibers obtained by defibrating the pieces of paper. Then, there is a mechanism where an air flow is generated by the rotation of the rotating blades, and the fibers defibrated ride this air flow and are transferred to the classifier unit 40 via a tubing 202. In a case where a dry-type defibrating unit 30 not provided with a wind generation mechanism is used, an airflow generation apparatus for generating an airflow toward the defibrating unit 30 from the crushing unit 20 should be separately provided.

The classifier unit 40 is for classifying the defibrated material into the ink particles and the fibers. In the present embodiment, a cyclone (a cyclone 40 serving as the classifier unit is described below) serving as the classifier unit 40 is applied and the transferred fibers are classified by air flow into the ink particles and deinked fibers (deinked defibrated material). Here, another type of classifier device with an air flow system may be used instead of the cyclone 40. In this case, for example, an elbow jet, an eddy classifier, or the like may be used as the classifier device with an air flow system other than the cyclone 40. The classifier device with an air flow system is for generating a swirling airflow, and separating and classifying by using differences in the centrifugal force received because of the size and density of the defibrated material, and allows for the classification points to be adjusted by adjusting the airflow speed and centrifugal force. The ink particles, which are smaller and less dense and the fibers that are larger and denser than the ink particles are thereby divided. The act of removing the ink particles from the fibers is called deinking.

For the cyclone 40, a cyclone of a tangential input format has a relatively simple structure. The cyclone 40 of the present embodiment is constituted of an introduction port 40*a* with introduction from the defibrating unit 30, a cylindrical part 41 to which the introduction port 40*a* leads in a tangential direction, a conical part 42 continuous with a lower part of the cylindrical part 41, a lower ejector port 40*b* provided to a lower part of the conical part 42, and an upper exhaust port 40*c* for discharging a fine powder, the upper exhaust port being provided to an upper middle of the cylindrical part 41. The conical part 42 decreases in diameter going vertically downward.

In the classification process, the air flow bearing the defibrated material introduced from the introduction port 40*a* of the cyclone 40 changes to a circumferential motion in the cylindrical part 41, where a centrifugal force is applied and synergy with the air flow increases the entanglement of the fibers and moves same toward an inverted conical part 42. The separated ink particles are introduced to the upper exhaust port 40*c* as a fine powder, along with air, and the deinking proceeds. A short fiber mixture containing large amounts of ink particles is discharged from the upper exhaust port 40*c* of the cyclone 40. The short fiber mixture containing large amounts of ink particles thus discharged is collected at the receiving unit 50 via a tubing 203 connected to the upper exhaust port 40*c* of the cyclone 40. In turn, the deinked fibers are transferred toward the web forming unit 70 via a tubing 204 from the lower ejector port 40*b* of the cyclone 40. There may also be suction from the upper exhaust port 40*c*.

Midway in the tubing 204 where the deinked fibers are transferred to the web forming unit 70 from the cyclone 40, there is provided the additive agent feeding unit 60 for adding an additive such as a resin (for example, a fusion-bondable resin or thermosetting resin) to the deinked fibers being conveyed. As examples of additives that can be fed in other than the fusion-bondable resin could also include flame retardants, whiteness enhances, sheet strengtheners, sizing agents, or the like. These additives are stored in an additive reservoir unit 61 and fed from a feed port 62 by a feeding mechanism (not shown).

The web forming unit 70 is for forming the web, comprising the resin and fibers fed from the tubing 204. The web forming unit 70 has a mechanism for uniformly dispersing the fibers in air, and a mechanism for depositing the dispersed fibers onto a mesh belt 73.

First, as the mechanism for uniformly dispersing the fibers in air, arranged in the web forming unit 70 is a forming drum 71 into the interior of which the fibers and resin are fed. Then, rotatingly driving the forming drum 71 makes it possible to uniformly mix the resin (additive) into the fibers. A screen having a plurality of small holes is provided to the surface of the forming drum 71. A rotatable needle roll is provided to the interior of the forming drum 71, and the fed fibers are made to float. Such a configuration makes it possible to uniform disperse in the air the fibers that have passed through the small holes.

In turn, disposed below the forming drum 71 is the endless mesh belt 73, on which a mesh stretched by stretching rollers 72 (in the present embodiment, these are four stretching rollers 72*a* to 72*d*) is formed. Turning of at least one of the stretching rollers 72 causes the mesh belt 73 to move in one direction.

Also, provided vertically below the forming drum 71 is a suction apparatus 75 serving as a suction unit for generating an air flow oriented vertically downward, with the mesh belt 73 therebetween. The suction apparatus 75 makes it possible to suction the fibers dispersed in the air onto the mesh belt 73.

Then, the fibers and the resin are unraveled with a needle roll or the like when the fibers, in an entangled state, are introduced to inside the forming drum 71 of the web forming unit 70 from the cyclone 40. The unraveled fibers the pass through the small-hole screen of the surface of the forming drum 71, and are deposited onto the mesh belt 73 due to the suction force coming from the suction apparatus 75. At this time, moving the mesh belt 73 in one direction makes it possible to form a web W that comprises the fibers and the resin and has been deposited in an elongated shape. A continuous web W is formed by continuously dispersing from the forming drum 71 and continuously moving the mesh belt 73. The mesh belt 73 may be metallic, resinous, or a non-woven fabric, and may even be anything provided that the fibers can be deposited and an air flow can be made to pass through. When the mesh of the mesh belt 73 has a hole diameter that is too large, then the fibers enter between the meshing and an unevenness occurs when the web (sheet) is formed, whereas when the mesh has too small a hole diameter, then it becomes difficult for the suction apparatus 75 to form a stable air flow. For this reason, preferably, the hole diameter of the mesh is adjusted as appropriate. The suction apparatus 75 can be configured by forming an enclosed box that has an open window of a desired size below the mesh belt, and suctioning air from outside the window and giving the inside of the box a more negative pressure than the outside air.

The web W that is formed on the mesh belt 73 is transferred by the transferring unit 100. The transferring unit 100 of the present embodiment refers to a process of transferring the web W from the mesh belt 73 until when the web W is ultimately fed into a stacker 160 as a sheet Pr (web W). As such, the mesh belt 73 functions as a part of the transferring unit 100, as do a transfer belt 101 described below, a variety of rollers, and the like. More specifically, first, the web W that has been formed on the mesh belt 73, which is a part of the transferring unit 100, is transferred in accordance with the transfer direction (the arrow in the drawing) by the rotational movement of the mesh belt 73. Next, the web W is delivered to the transfer belt 101 from the mesh belt 73, and transferred in accordance with the transfer direction (the arrow in the drawing).

The first cutting unit 110, which cuts the web W in a direction intersecting with the transfer direction of the web W being transferred, is arranged on the downstream side of the transfer belt 101 in the transfer direction of the web W. The first cutting unit 110 is provided with a cutter and, as illustrated in FIG. 2A, cuts the continuous web W into the form of a sheet in accordance with a cutting position CP that is set to a predetermined length. This makes it possible to reduce the occurrence of, inter alia, skewing applied to the transfer of the web W, because the web W changes from a continuous form to the form of a sheet and the length dimension of the web W in the transfer direction is shorter.

Then, the heating unit 120, which heats the cut web W with a first roller 121, is arranged on the downstream side in the transfer direction of the web W from the first cutting unit 110. The heating unit 120 is for causing the fibers included in the web W to bind to one another, with the resin interposed therebetween. In the present embodiment, there are heating units 120 (120*a*, 120*b*) provided to two places. More specifically, the heating unit 120*a* is arranged on the downstream side in the transfer direction of the web W from the first cutting unit 110, and the heating unit 120*b* is arranged on the downstream side of the heating unit 120*a*. A pair of first rollers 121 are provided to each of the heating units 120*a*, 120*b*. A heating member such as a heater is provided to a rotational axis center part of the first roller 121, and passing the web W between the pair of first rollers 121 makes it possible to heat and compress the web W being transferred. When the web W is heated and compressed by the pair of first rollers 121, this makes the resin melt and become more readily entangled with the fibers, and also reduces the spacing between fibers and increases the points of contact between the fibers. This raises the density and improves the strength of the resulting web W. In the present embodiment, providing the heating units 120 (120*a*, 120*b*) to two places makes it possible for ample time for heating and compression to be ensured and makes it possible to reliably improve the strength of the web W. Configuring the heating units 120 as the first rollers 121 makes it possible to form the sheet while the web is being transferred continuously, in comparison to a case where the heating units 120 are configured as a planar pressing apparatus. A case where a planar pressing apparatus is used would necessitate a buffer unit for temporarily giving slack to the web being transferred when the pressing is being performed. In other words, using the heating rollers is more capable of reducing the size of the configuration of the sheet manufacturing apparatus 1 overall.

The second cutting unit 130, which cuts the web W along the transfer direction of the web W, is arranged more to the downstream side in the transfer direction than the heating units 120. The second cutting unit 130 is provided with a cutter and, as illustrated in FIG. 2B, cuts in accordance with a predetermined cutting position CP in the transfer direction of the web W. A sheet Pr (web W) of a desired size is thereby formed. The cut sheet Pr (web W) is then loaded onto the stacker 160, or the like. As such, in the present embodiment, first the transferred web W is cut into the form of a sheet by the first cutting unit 110, and then the web W, now in a state where skewing has been reduced, is cut along the transfer direction at the second cutting unit 130. For this reason, it is possible to accurately cut the web W to the desired dimensions.

In the present embodiment, there is the cooling unit 150, which cools the web W, between the heating units 120 and the second cutting unit 130. The cooling unit 150 is a unit that does not heat. A heating unit such as a heater is not provided to the cooling unit 150. The cooling unit 150 of the present embodiment is provided with a pair of cooling rollers 151. As such, the cooling unit 150 cools the web W and also compresses the web W. The cooling unit 150 therefore has the functions of lowering the temperature of the web W and also improving the strength of the web W. The cooling rollers 151 have, for example, an air cooling mechanism provided with a hollow cored bar made of metal and an air injection unit for injecting air into the hollow section. This provides such a configuration that upon contact with the web W having been heated by the heating units 120, there is no rise to the temperature of the heated web W or higher. More specifically, the configuration is such that contact between the cooling rollers 151 and the web causes the heat of the web W to be dissipated via the cooling rollers 151, and causes the temperature of the web W to approach that of the ambient temperature. This cools the web W and causes the melted resin to cool and harden, thereby reliably causing the fibers to bind to one another with the resin interposed therebetween. The cooling unit 150 is not limited to the format of cooling of the present embodiment, and cooling need not be performed provided that the heat is properly dissipated. A case of cooling may be, for example, also be a water cooling format.

In the present embodiment, on the upstream side in the transfer direction of the web W from the first cutting unit 110 and between the web forming unit 70 and the first cutting unit 110, there is provided a preheating unit 140 having second rollers 141 for heating the web W at lower temperature or lower load than the heating units 120. A pair of second rollers 141 are provided to the preheating unit 140. A heating member such as a heater is provided to a rotational axis center part of the second rollers 141, and causing the web W to pass between the pair of second rollers makes it possible to heat and compress the web W being transferred. Here, at the second rollers 141, the web W is heated in advance at a lower temperature or lower load than the heating units 120. The strength of the web W is thereby increased. Then, the web W having passed through the preheating unit 140 is cut by the first cutting unit 110. That is to say, it becomes possible to cut the web W in a state where strength has been imparted, and therefore at the time of cutting, any breaking or the like of the web W is curbed and the web W can be cut properly.

The following effects can be obtained according to the embodiment as described above.

The web W having been formed by the web forming unit 70 is cut by the first cutting unit 110 in a direction intersecting with the transfer direction of the web W. Then, the cut web W is transferred through the heating units 120 (120*a*, 12*b*), the cooling unit 150, and the second cutting unit 130 via the transferring unit 100. Because the web W having been cut by the first cutting unit 110 is transferred, it is possible to suppress the occurrence of skewing (such as meandering or bending in the transfer of the web) of the web W amidst the transfer. The web W is heated and compressed by the first rollers 121 and the second rollers 141. This makes it possible to reduce in size the overall configuration of the sheet manufacturing apparatus 1, compared to a case where a planar pressing machine is used.

With a configuration provided with a lower pressing unit and upper pressing unit that are smaller than the size of the surface of the web, which has been cut to a predetermined length, it becomes possible only to press on a portion of the overall surface of the cut web, and therefore pressing on the overall surface of the web necessitates performing the work of pressing a plurality of times, thus increasing the number of processing steps. In a case where the work of pressing is repeatedly performed, also, the web ends up having an uneven thickness and density because there are overlapping portions that are pressed in the web. In the present embodiment, because the rollers are used to heat and compress, it is possible for heating and compression to take place at the same time as transfer, and the web will not have an uneven thickness or density.

The "sheet" as in the present embodiment primarily refers to something for which fibers are the stock material and which is made into a sheet. However, there is no limitation thereto, and the sheet may be in the form of a board, or the in the form of a web (or in a shape that is uneven). The stock material may also be cellulose or other plant fibers, polyethylene terephthalate (PET), polyester, or other chemical fibers, or wool, silk, or other animal fibers. In the present application, the "sheet" would be divided in paper and nonwoven fabrics. Paper encompasses modes where pure pulp or used paper, as a stock material, is formed into a thin sheet, or the like, and encompasses recording paper, wallpaper, wrapping paper, colored paper, picture paper, Kent paper, or the like where writing or printing is the objective. Nonwoven fabrics are thinner and have less strength than paper, and encompass nonwoven fabrics, fiber board, tissue paper, kitchen paper, cleaners, filters, liquid-absorbing materials, sound-absorbing materials, mats, and the like.

The present invention is not limited to the embodiment described above, but rather a variety of modifications, improvements, or the like could be made to the embodiment described above. Modification examples shall be described below.

Modification Example 1

The embodiment described above is provided with the preheating unit 140 having the second rollers 141 for heating the web W at a lower temperature or lower load than the heating units 120, between the web forming unit 70 and the first cutting unit 110; however, there is no limitation to being of this configuration. For example, the configuration may be one where the preheating unit 140 has been omitted. Even still, it would remain possible to have effects similar to what is described above and also to reduce in size the overall configuration of the sheet manufacturing apparatus 1.

Modification Example 2

The embodiment described above is configured so that there are two heating units 120*a*, 120*b* arranged as the heating unit 120, but there is no limitation to being of this configuration. For example, depending on the thickness, material or other attributes of the web W being manufactured (the sheet Pr), the configuration may be one where only one heating unit 120 is arranged, or the configuration may be one where three or more heating units 120 are arranged, and settings may be made as appropriate. So doing makes it possible to manufacture (form) the sheet Pr (web W) efficiently.

Modification Example 3

Figure 3:
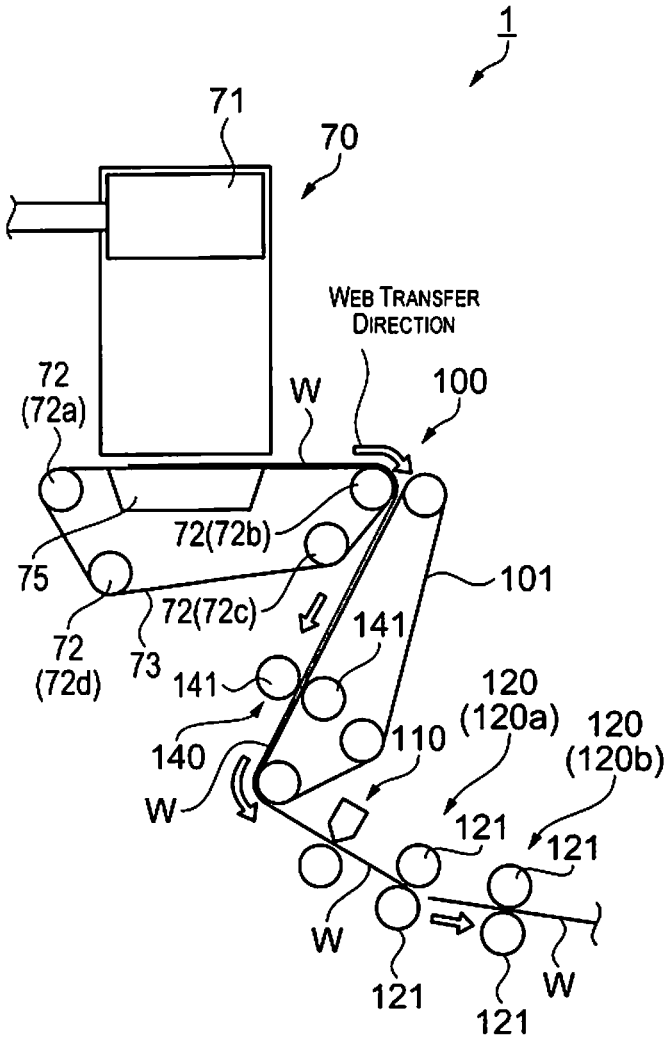
FIG. 3 is a schematic diagram illustrating minimum constituent elements of the sheet manufacturing apparatus.

FIG. 3 is a drawing illustrating the minimum constituent elements in the present application. The sheet manufacturing apparatus 1 is provided with the web forming unit 70, the transferring unit 100, the first cutting unit 110, and the heating unit 120. In a case where fibers and resin that have been mixed together in advance is used as the stock material, then there is no need for the constituent elements more upstream in the direction of flow than the web forming unit 70, such as the supplying unit 10, the crushing unit 20, the defibrating unit 30, the classifier unit 40, or the additive agent feeding unit 60 (see FIG. 1). Also, the temperature drops naturally even without the cooling rollers 151 (the cooling unit 150 (see FIG. 1)). The second cutting unit 130 (see FIG. 1) is also unnecessary, provided that a cut is made after the sheet has been taken out from the sheet manufacturing apparatus 1. Each of the constituent elements understood to be unneeded on the basis of the configuration in FIG. 3 may also be added.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus, comprising:

a web forming unit configured to form a web that includes fibers and a resin;

a transferring unit configured to transfer the web that has been formed;

a first cutting unit configured to cut the web in a direction intersecting with a transfer direction of the web being transferred; and a heating unit having a first roller that includes a first heater disposed within the first roller and is configured to heat the web that has been cut.

2. The sheet manufacturing apparatus as set forth in claim 1, further comprising a second cutting unit configured to cut the web along the transfer direction of the web, the second cutting unit being arranged on the downstream side in the transfer direction relative to the heating unit.

3. The sheet manufacturing apparatus as set forth in claim 1, further comprising a cooling unit configured to cool the web, the cooling unit being arranged between the heating unit and the second cutting unit in the transfer direction.

4. The sheet manufacturing apparatus as set forth in claim 1, wherein the heating unit is configured to cause the fibers included in the web to bind to one another, with the resin interposed therebetween.

5. The sheet manufacturing apparatus as set forth in claim 1, further comprising a preheating unit that includes a second roller configured to heat the web at a lower temperature than the heating unit, the preheating unit being arranged between the web forming unit and the first cutting unit in the transfer direction.

6. The sheet manufacturing apparatus as set forth in claim 5, wherein the second roller has a second heater disposed within the second roller.

7. The sheet manufacturing apparatus as set forth in claim 6, wherein the second heater is provided to a rotational axis center part of the second roller.

8. The sheet manufacturing apparatus as set forth in claim 1, wherein the first heater is provided to a rotational axis center part of the first roller.

9. The sheet manufacturing apparatus as set forth in claim 1, wherein the first cutting unit is configured to cut the web along a cutting position that extends in a perpendicular direction perpendicular to a transfer direction in which the transferring unit is configured to transfer the web.

10. A sheet manufacturing apparatus, comprising:

a web forming unit configured to form a web that includes fibers and a resin;

a transferring unit configured to transfer in a transfer direction the web that has been formed;

a first cutting unit configured to cut the web in a direction intersecting with the transfer direction;

a heating unit arranged downward in the transfer direction relative to the first cutting unit and having a first roller configured to heat the web that has been cut by the first cutting unit; and a second cutting unit arranged downward in the transfer direction relative to the heating unit and configured to cut, along the transfer direction, the web that has been heated by the heating unit.

* * * * *